US012264679B2

(12) United States Patent
Brown et al.

(10) Patent No.: US 12,264,679 B2
(45) Date of Patent: Apr. 1, 2025

(54) DOWNHOLE TRANSMISSION WITH WELLBORE FLUID FLOW PASSAGE

(71) Applicant: Halliburton Energy Services, Inc., Houston, TX (US)

(72) Inventors: Donn J. Brown, Tulsa, OK (US); Trevor Alan Kopecky, Tulsa, OK (US); Ketankumar Kantilal Sheth, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 244 days.

(21) Appl. No.: 17/976,356

(22) Filed: Oct. 28, 2022

(65) Prior Publication Data

US 2024/0141903 A1 May 2, 2024

(51) Int. Cl.

| | |
|---|---|
| ***F04D 13/10*** | (2006.01) |
| ***E21B 43/12*** | (2006.01) |
| ***E21B 43/38*** | (2006.01) |
| ***E21B 47/008*** | (2012.01) |
| ***F04D 13/02*** | (2006.01) |
| ***F04D 13/08*** | (2006.01) |
| ***F04D 15/00*** | (2006.01) |
| ***F04D 29/62*** | (2006.01) |

(52) U.S. Cl.

CPC ..... *F04D 13/10* (2013.01); *E21B 43/121* (2013.01); *E21B 43/128* (2013.01); *E21B 47/008* (2020.05); *F04D 13/02* (2013.01); *F04D 13/021* (2013.01); *F04D 13/028* (2013.01); *F04D 13/086* (2013.01); *F04D 15/0066* (2013.01); *F04D 29/628* (2013.01); *E21B 43/38* (2013.01)

(58) Field of Classification Search

CPC .... F04D 13/10; F04D 15/0066; F04D 13/086; F04D 29/628; F04D 13/028; F04D 13/021; F04D 13/02; E21B 43/128; E21B 47/008; E21B 43/121

See application file for complete search history.

(56) References Cited

U.S. PATENT DOCUMENTS 3,677,665 A * 7/1972 Corkill ..... F04C 2/1071 418/48
4,417,860 A * 11/1983 Justice ..... F04B 9/047 417/415

(Continued)

*Primary Examiner* — Peter J Bertheaud
(74) *Attorney, Agent, or Firm* — Conley Rose, P.C.; Rodney B. Carroll

(57) ABSTRACT

An electric submersible pump (ESP) assembly comprising an electric motor, a seal section disposed uphole of the electric motor, a gas separator disposed uphole of the seal section, a downhole transmission assembly disposed uphole of the gas separator, comprising a flow passage fluidically coupled to a liquid phase discharge port of the gas separator, a first drive shaft coupled to a drive shaft of the gas separator, a second drive shaft, and a transmission that mechanically couples the first drive shaft to the second drive shaft, wherein the transmission is configured to turn the second drive shaft at a slower angular speed than the angular speed of the first drive shaft, and a centrifugal pump assembly disposed uphole of the downhole transmission assembly, having a fluid inlet coupled to a fluid outlet of the downhole transmission assembly, and having a drive shaft coupled to the second drive shaft.

28 Claims, 7 Drawing Sheets

(56) References Cited

U.S. PATENT DOCUMENTS

| | | | | |
|---|---|---|---|---|
| 5,573,063 | A * | 11/1996 | Morrow | F16H 1/20 417/423.6 |
| 2013/0343932 | A1* | 12/2013 | Stinessen | F04D 29/058 417/410.1 |
| 2016/0341281 | A1* | 11/2016 | Brunvold | F04D 17/122 |

* cited by examiner

DOWNHOLE TRANSMISSION WITH WELLBORE FLUID FLOW PASSAGE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pumps (hereafter "ESP" or "ESPs") may be used to lift production fluid in a wellbore. Specifically, ESPs may be used to pump the production fluid to the surface in wells with low reservoir pressure. ESPs may be of importance in wells having low bottomhole pressure or for use with production fluids having a low gas/oil ratio, a low bubble point, a high water cut, and/or a low API gravity. Moreover, ESPs may also be used in any production operation to increase the flow rate of the production fluid to a target flow rate.

Generally, an ESP comprises an electric motor, a seal section, a pump intake, and one or more pumps (e.g., a centrifugal pump). These components may all be connected with a series of shafts. For example, the pump shaft may be coupled to the motor shaft through the intake and seal shafts. An electric power cable provides electric power to the electric motor from the surface. The electric motor supplies mechanical torque to the shafts, which provide mechanical power to the pump. Fluids, for example reservoir fluids, may enter the wellbore where they may flow past the outside of the motor to the pump intake. These fluids may then be produced by being pumped to the surface inside the production tubing via the pump, which discharges the reservoir fluids into the production tubing.

The reservoir fluids that enter the ESP may sometimes comprise a gas fraction. These gases may flow upwards through the liquid portion of the reservoir fluid in the pump. The gases may even separate from the other fluids when the pump is in operation. If a large volume of gas enters the ESP, or if a sufficient volume of gas accumulates on the suction side of the ESP, the gas may interfere with ESP operation and potentially prevent the intake of the reservoir fluid. This phenomenon is sometimes referred to as a "gas lock" because the ESP may not be able to operate properly due to the accumulation of gas within the ESP.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
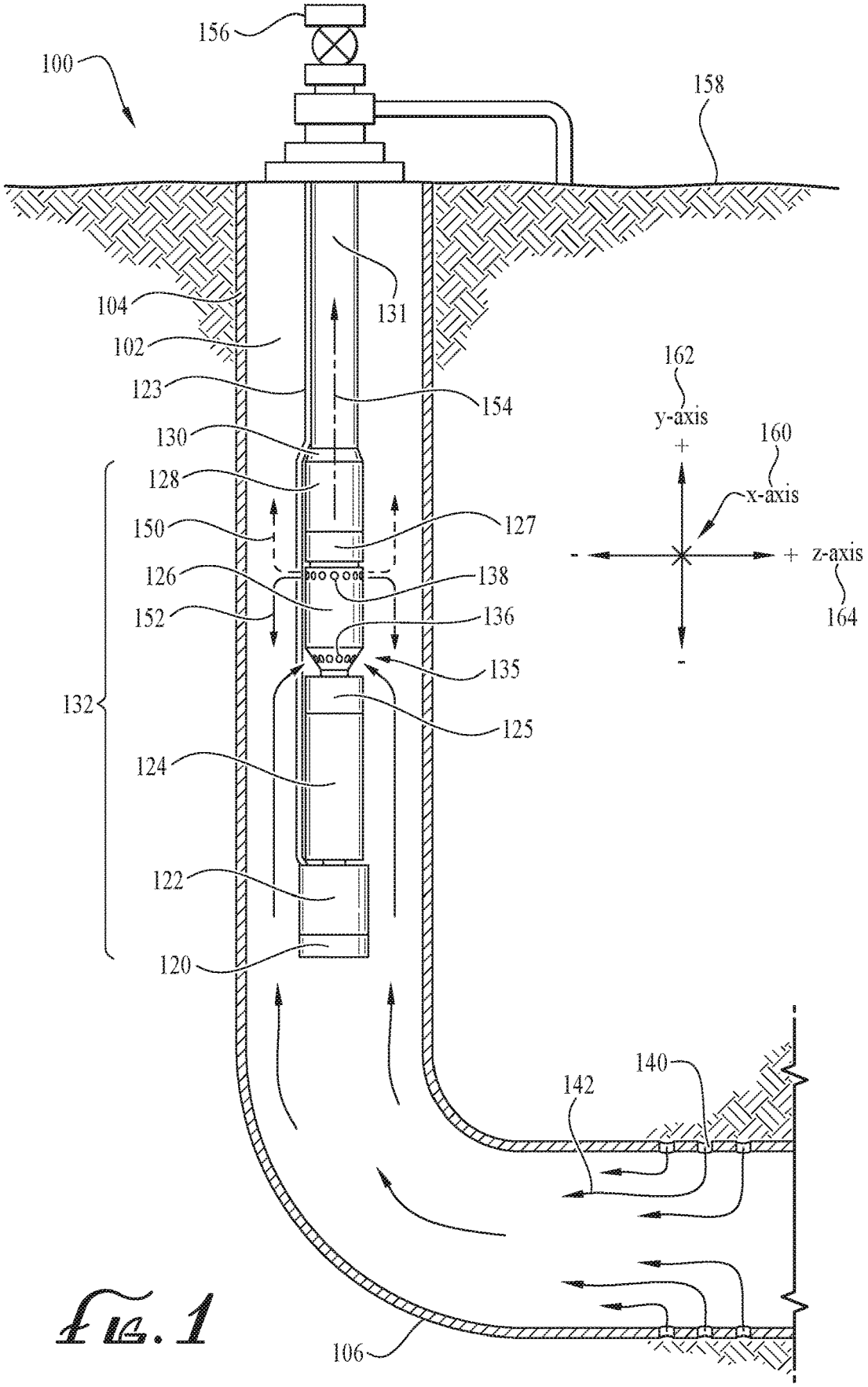
FIG. 1 is an illustration of an electric submersible pump (ESP) assembly disposed in a wellbore according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," "down," "uphole," and "downhole" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" and "downhole" are directed counter to the direction of flow of well fluid, towards the source of well fluid. "Up" and "uphole" are directed in the direction of flow of well fluid, away from the source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component. As used herein, the term "about" when referring to a measured value or fraction means a range of values+/−5% of the nominal value stated. Thus, "about 1 inch," in this sense of "about," means the range 0.95 inches to 1.05 inches, and "about 5000 PSI," in this sense of "about," means the range 4750 PSI to 5250 PSI. Thus, the fraction "about 8/10s" means the range 76/100s to 84/100s.

A gas separator in an electric submersible pump (ESP) assembly receives a flow of wellbore fluid, exhausts a portion of that received flow out a gas phase discharge port and conveys the remainder of that received flow out a liquid phase discharge port to an inlet of a pump of the ESP assembly. When wellbore fluid has a relatively high gas-to-liquid ratio, it is desirable to exhaust relatively more of the wellbore fluid out the gas phase discharge port. The present disclosure teaches incorporating one or more downhole transmissions in the ESP assembly so that the gas separator can be turned at a higher RPM (i.e., at a higher angular speed) while the pump can be turned at a lower RPM (i.e., at a lower angular speed). By running the gas separator at higher RPM, more centrifugal force is imparted to the wellbore fluid, increasing the separation of gas phase fluid (or fluid having a higher gas-to-liquid ratio) from liquid phase fluid (or fluid having a lower gas-to-liquid ratio). Additionally, by running the gas separator at higher RPM, proportionally more of the wellbore fluid will be exhausted out the gas phase discharge port of the gas separator relative to the wellbore fluid that will be flowed via the liquid phase discharge port to the inlet of the pump, which is useful in wells producing wellbore fluid with a higher gas-to-liquid ratio.

In an embodiment, a first downhole transmission assembly provides flow passages for wellbore fluid to flow through and a transmission to increase or decrease RPMs. A first downhole transmission assembly may be installed between an uphole end of a gas separator and a downhole end of a pump. The wellbore fluid flowing out of the liquid phase discharge ports of the gas separator flow through the flow passages of the first downhole transmission assembly to the inlet of the pump. A drive shaft of the gas separator is coupled to a first drive shaft of the first downhole transmission assembly, a transmission couples the first drive shaft to a second drive shaft of the first downhole transmission assembly, wherein the transmission turns the second drive shaft at a lower RPM than the RPM of the first drive shaft. In an embodiment, the transmission comprises an annular gearbox, such as an epicyclic gear train or a planetary gearset. In an embodiment, a different kind of transmission may be employed. In an embodiment, the transmission reverses the rotating sense of the second drive shaft versus the first drive shaft.

A second downhole transmission assembly may be installed between an uphole end of a seal section of the ESP assembly and the gas separator. A drive shaft of the seal section is coupled to a third drive shaft of the second downhole transmission assembly, a transmission couples the third drive shaft to a fourth drive shaft of the second downhole transmission assembly, wherein the transmission turns the fourth drive shaft at a higher RPM than the RPM of the third drive shaft. Depending on where the fluid intake of the ESP assembly is located, the second downhole transmission assembly may also provide flow passages or may not provide flow passages. For example, if an uphole end of the seal section is coupled to the downhole end of a fluid intake, and an uphole end of the fluid intake is coupled to a downhole end of the second downhole transmission assembly, there will be internal flow passages for wellbore fluid provided by the second downhole transmission assembly. By contrast, if the uphole end of the seal section is coupled to the downhole end of the second downhole transmission assembly, and the uphole end of the second downhole transmission assembly is coupled to the downhole end of the fluid intake, the second downhole transmission assembly may not provide internal flow passages for wellbore fluid.

Turning now to FIG. 1 a well site environment 100, according to one or more aspects of the disclosure, is described. The well site environment 100 comprises a wellbore 102 that is at least partially cased with casing 104. As depicted in FIG. 1, the wellbore 102 is substantially vertical, but the electric submersible pump (ESP) assembly 132 described herein also may be used in a wellbore 102 that has a deviated or horizontal portion. The well site environment 100 may be at an on-shore location or at an off-shore location. The ESP assembly 132 in an embodiment comprises an optional sensor package 120, an electric motor 122, a seal section 124, an optional second downhole transmission assembly 125, a fluid intake 135, a gas separator 126, a first downhole transmission assembly 127, and a centrifugal pump assembly 128. The fluid intake 135 defines a plurality of inlet ports 136. The gas separator 126 defines a plurality of gas phase discharge ports 138. In some embodiments, the fluid intake 135 may be an integral part of the gas separator 126.

The centrifugal pump assembly 128 may couple to a production tubing 131 via a connector 130. An electric cable 123 may attach to the electric motor 122 and extend to the surface 158 to connect to an electric power source. The casing 104 and/or wellbore 102 may have perforations 140 that allow wellbore fluid 142 to pass from the subterranean formation through the perforations 140 and into the wellbore 102. In some contexts, wellbore fluid 142 may be referred to as reservoir fluid.

The wellbore fluid 142 may flow uphole towards the ESP assembly 132 and into the fluid intake 135. The wellbore fluid 142 may comprise a liquid phase fluid. The wellbore fluid 142 may comprise a gas phase fluid mixed with a liquid phase fluid. The wellbore fluid 142 may comprise only a gas phase fluid (e.g., simply gas). Over time, the gas-to-liquid ratio of the wellbore fluid 142 may change dramatically. For example, in the circumstance of a horizontal or deviated wellbore, gas may build up in high points in the roof of the wellbore and after accumulating sufficiently may "burp" out of these high points and flow downstream to the ESP assembly 132 as what is commonly referred to as a gas slug. Thus, immediately before a gas slug arrives at the ESP assembly 132, the gas-to-liquid ratio of the wellbore fluid 142 may be very low (e.g., the wellbore fluid 142 at the ESP assembly 132 is mostly liquid phase fluid); when the gas slug arrives at the ESP assembly 132, the gas-to-liquid ratio is very high (e.g., the wellbore fluid 142 at the ESP assembly 132 is entirely or almost entirely gas phase fluid); and after the gas slug has passed the ESP assembly 132, the gas-to-liquid ratio may again be very low (e.g., the wellbore fluid 142 at the ESP assembly 132 is mostly liquid phase fluid).

Under normal operating conditions (e.g., wellbore fluid 142 is flowing out of the perforations 140, the ESP assembly 132 is energized by electric power, the electric motor 110 is turning, and a gas slug is not present at the ESP assembly 132), the wellbore fluid 142 enters the fluid intake 135, flows into the gas separator 126. Part of the wellbore fluid 142 received by the gas separator 126 is exhausted out the gas phase discharge ports 138 as gas laden fluid 150 and fluid 152. Part of the wellbore fluid 142 received by the gas separator 126 is flowed through liquid phase discharge ports of the gas separator 126 to the first downhole transmission assembly 127, through flow passages of the first downhole transmission assembly 127 to the centrifugal pump assembly 128, out the centrifugal pump assembly 128, and uphole as fluid 154 via the production tubing 131 to a wellhead 156 located at the surface 158. The first downhole transmission assembly 127 allows the pump 128 to operate at a different speed than the gas separator 126. The centrifugal pump assembly 128 provides pumping pressure or pump head to lift the wellbore fluid 154 to the surface 158. The wellbore fluid 142 may comprise hydrocarbons such as crude oil and/or natural gas. The wellbore fluid 142 may comprise water. In a geothermal application, the wellbore fluid 142 may comprise hot water. An orientation of the wellbore 102 and the ESP assembly 132 is illustrated in FIG. 1 by an x-axis 160, a y-axis 162, and a z-axis 164.

Figure 2A:
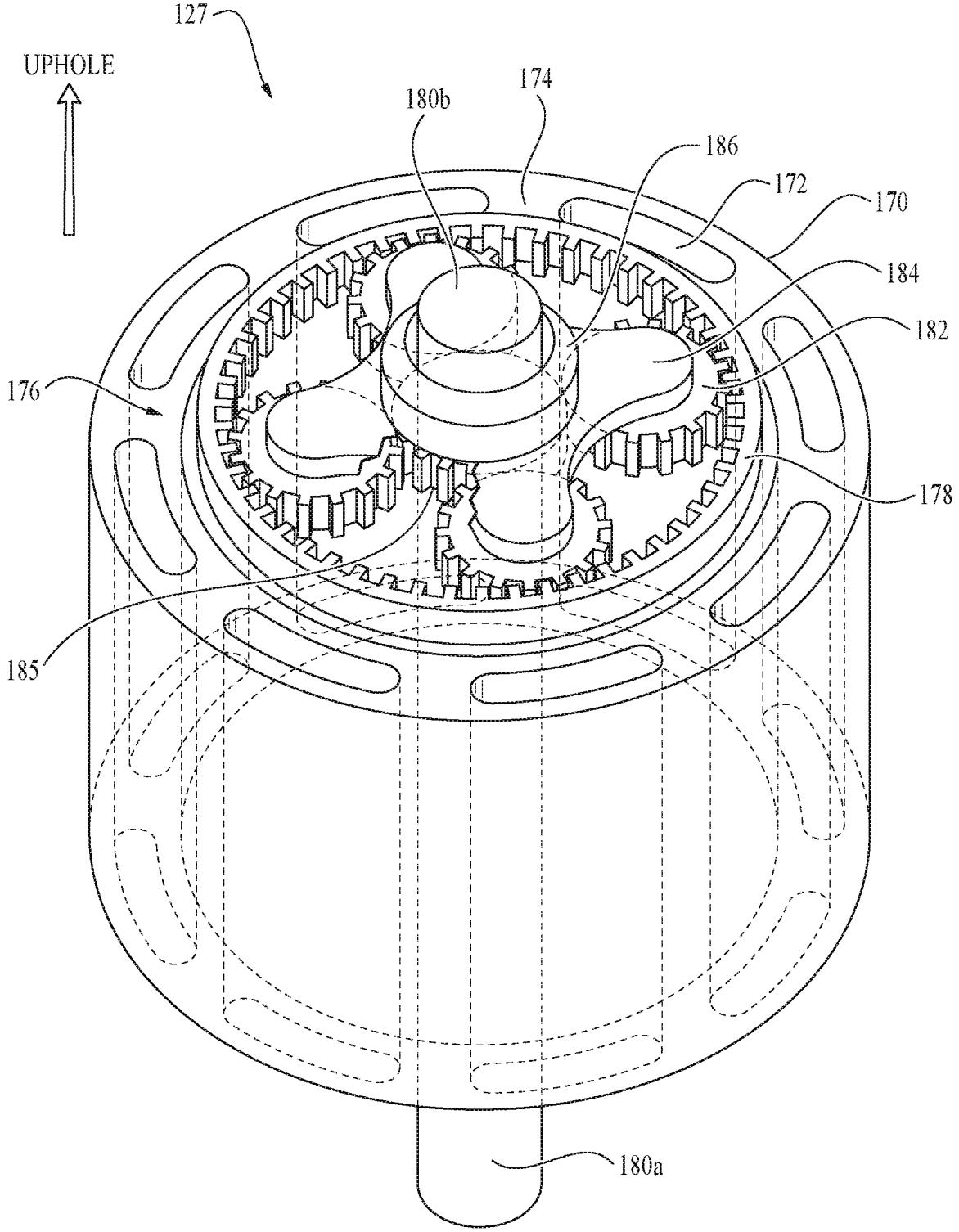
FIG. 2A, FIG. 2B, and FIG. 2C are illustrations of a downhole transmission assembly according to an embodiment of the disclosure.
Figure 2B:
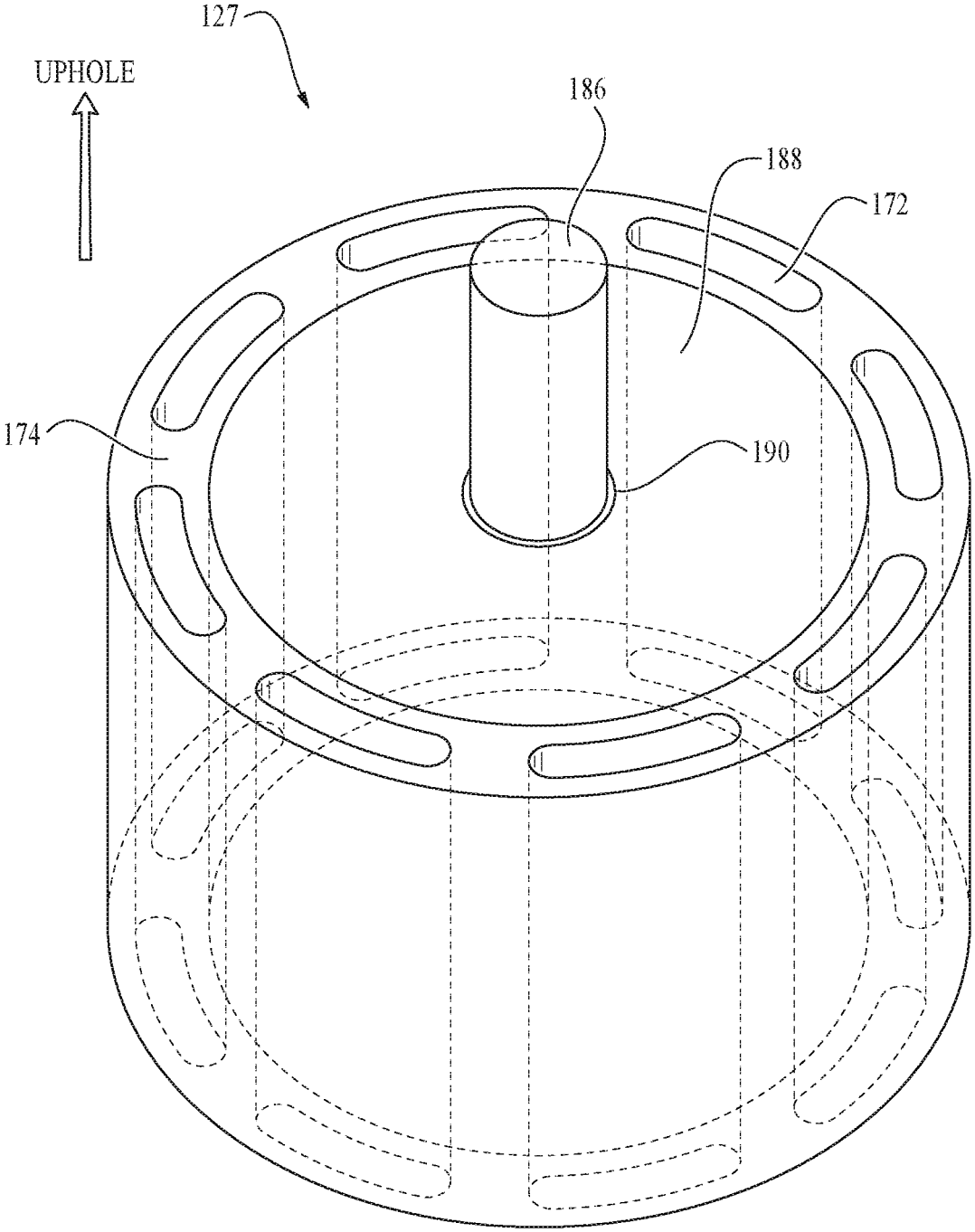
Figure 2C:
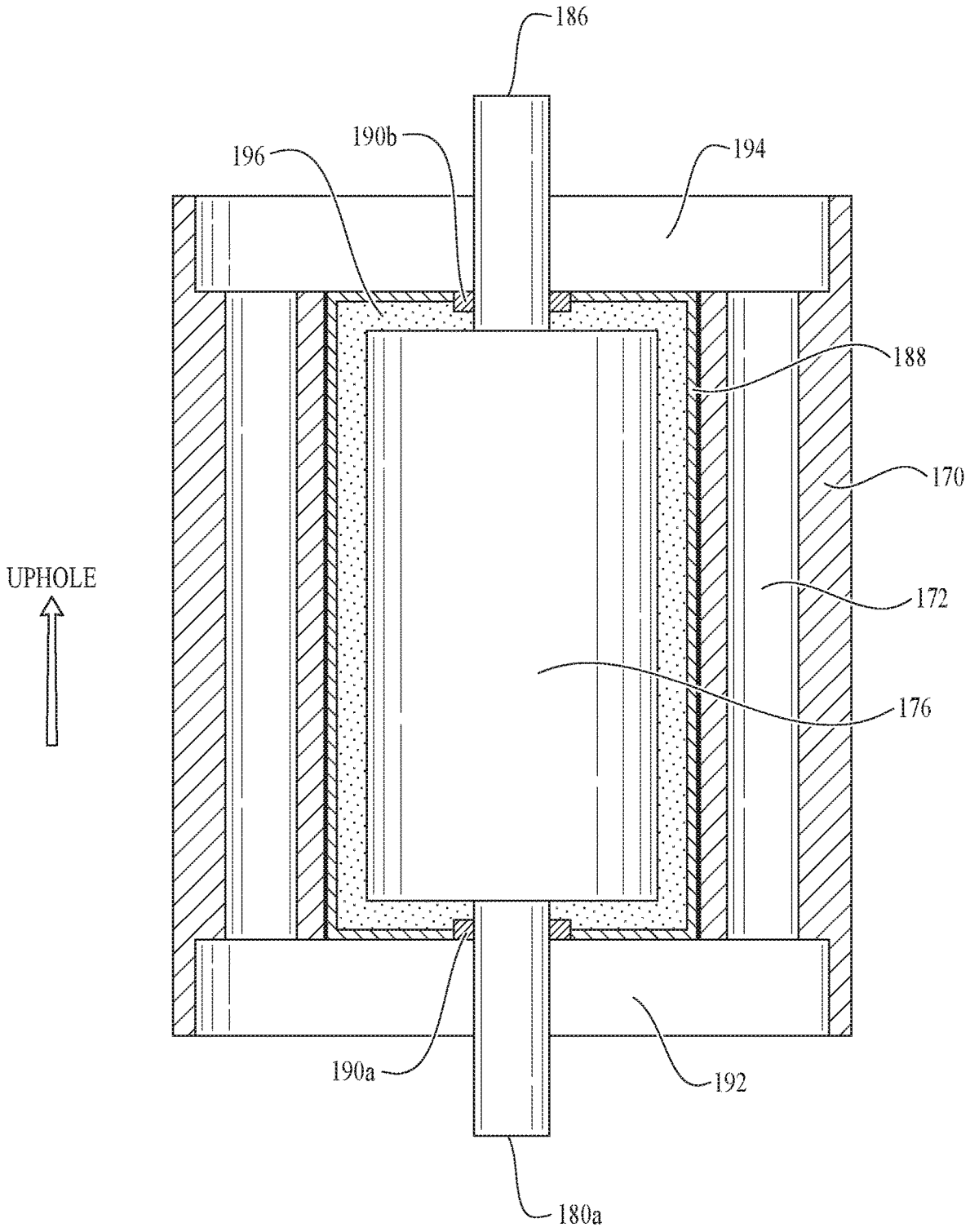

Turning now to FIG. 2A, FIG. 2B, and FIG. 2C, the first downhole transmission assembly 127 is described. The first downhole transmission assembly 127 is an assembly retained within a housing 170 configured for deploying downhole as part of the ESP assembly 132 that retains a transmission 176 and defines one or more flow passages 172. The flow passages 172 are illustrated in FIG. 2A as having a generally curved bean-like shaped radial cross-section that extends axially from near a downhole end to near an uphole end of the housing 170. In another embodiment, however, the flow passages 172 may have a differently shaped radial cross-section. The housing 170 defines a plurality of support structures 174 between the flow passages 172. In an embodiment, the housing 170 is machined out of a solid piece of metal. In another embodiment, the housing 170 is cast in metal, the central opening of the housing 170 is machined and smoothed, and flow passages 172 are cut through after the casting operation. The number of flow passages 172 may be different in different embodiments of the housing 170. The first downhole transmission assembly 127 comprises a first drive shaft 180 having a downhole end 180*a* and an uphole end 180*b*. The first downhole transmission assembly 127 comprises a second drive shaft 186.

The transmission 176 mechanically couples the first drive shaft 180 to the second drive shaft 186 such that the RPM of the first drive shaft 180 is different than the RPM of the second drive shaft 186. In an embodiment, the RPM of the first drive shaft 180 is 1.1 times to 20 times the RPM of the second drive shaft 186. In another embodiment, the RPM of the first drive shaft 180 is 1.1 times to 10 times the RPM of the second drive shaft 186. In yet another embodiment, the RPM of the first drive shaft 180 is 1.25 times to 3 times the RPM of the second drive shaft 186. In yet another embodiment, the RPM of the first drive shaft 180 is 1.25 times to 2 times the RPM of the second drive shaft 186. In still another embodiment, the RPM of the first drive shaft 180 is 1.25 times to 1.75 times the RPM of the second drive shaft 186. In an embodiment, the RPM of the first drive shaft 180 is about 1.5 times the RPM of the second drive shaft 186. In some embodiments, the RPM of the first drive shaft 180 is slower than the RPM of the second drive shaft 186. In an embodiment, the RPM of the second drive shaft 186 is 1.1 times to 5 times the RPM of the first drive shaft 180. In an embodiment, the RPM of the second drive shaft 186 is 1.1 times to 4 times the RPM of the first drive shaft 180. In an embodiment, the RPM of the second drive shaft 186 is 1.1 times to 3 times the RPM of the first drive shaft 180. In an embodiment, the RPM of the second drive shaft 186 is 1.1 times to 2 times the RPM of the first drive shaft 180. In an embodiment, the RPM of the second drive shaft 186 is 1.25 times to 1.75 times the RPM of the first drive shaft 180.

As illustrated, first drive shaft 180 of the downhole transmission assembly 127 couples to an uphole end of a drive shaft of the gas separator 126, and the second drive shaft 186 of the downhole transmission assembly 127 couples to a downhole end of a drive shaft of the centrifugal pump assembly 128. In an embodiment, the downhole end of the second drive shaft 186 may be hollow to accommodate the uphole end of the first drive shaft 180*b*. Thus, as the drive shaft of the gas separator 126 turns at a first RPM, the transmission 176 converts this first RPM to drive the drive shaft of the centrifugal pump assembly 128 at a second RPM, where the second RPM is lower than the first RPM. In an embodiment, an end of the first drive shaft 180 defines a plurality of male splines that couple via a coupling sleeve interiorly defining female splines to similar male splines defined at an uphole end of the drive shaft of the gas separator 126, and an end of the second drive shaft 186 defines a plurality of male splines that couple via a second coupling sleeve interiorly defining female splines to similar male splined defined at a downhole end of the drive shaft of the centrifugal pump assembly 128.

In another embodiment, however, the downhole transmission assembly 127 may be flipped or rotated by 180 degrees such that the second drive shaft 186 of the downhole transmission assembly 127 is coupled to the uphole end of the drive shaft of the gas separator 126, and the first drive shaft 180 of the downhole transmission assembly 127 is coupled to the downhole end of the drive shaft of the centrifugal pump assembly 128. In this case, the drive shaft of the gas separator turns at a third RPM, the transmission 176 converts this third RPM to drive the drive shaft of the centrifugal pump assembly 128 at a fourth RPM, where the fourth RPM is higher than the third RPM.

In an embodiment, the interior of the housing 170 and a transmission housing 188 define a keyway, and a key may be installed in the two keyways to align and secure the transmission housing 188 within the housing 170. In an embodiment, the transmission housing 188 encloses and seals the transmission 176 off from wellbore fluid that may be contacting the outside of the transmission housing 188 on its downhole end and on its uphole end, for example proximate to an inlet 192 of the downhole transmission assembly 127 and proximate an outlet 194 of the downhole transmission assembly 127. The interior of the transmission housing 188 may be filled at least partially with lubricating fluid 196, such as gear oil. A first mechanical shaft seal 190*a* may be retained by the transmission housing 188 and enclose the first drive shaft 180*a* where it passes through the transmission housing 188, and a second mechanical shaft seal 190*b* may be retained by the transmission housing 188 and enclose the second drive shaft 186 where it passes through the transmission housing 188.

In an embodiment, the transmission 176 comprises an annular gear box. In an embodiment, the transmission 176 comprises an epicyclic gear train or a planetary gearset. The transmission 176 illustrated in FIG. 2A is an epicyclic gear train, but in other embodiments the transmission 176 may be embodied in a different form or type of transmission. In an embodiment, the transmission 176 comprises a ring gear 178 that is retained by an interior of the housing 188. The transmission 176 also comprises a plurality of planet gears 182 retained by axles of a planetary gear carrier 184 and that mesh with the ring gear 178. The transmission 176 also comprises a sun gear 185 that meshes with the planet gears. In FIG. 2A, it is understood that the lower left portion of the planetary gear carrier 184 is illustrated as partially cut-away to better exhibit the disposition of the sun gear 185. The sun gear 185 is coupled to the first drive shaft 180. The planetary gear carrier 184 is coupled to a carrier shaft 186 that is coupled to the second drive shaft 186. While the epicyclic gear train illustrated in FIG. 2A has four planet gears 182, in another embodiment the transmission 176 may comprise three planet gears, five planet gears, six planet gears, or some larger number of planet gears less than twenty planet gears. By varying the diameters of the planet gears 182 and of the sun gear 185, the angular speed offsets between the first drive shaft 180 and the second drive shaft 186 can be set to a desired value.

In an embodiment, the second downhole transmission assembly 125 may be substantially similar to the first downhole transmission assembly 127, but may instead have the transmission 176 reversed in sense (for example, by flipping the transmission 176 described with reference to FIG. 2A, FIG. 2B, and FIG. 2C upside down) such that the RPM provided by an uphole end of a drive shaft of the seal section 124 is slower than the RPM provided to a downhole end of a drive shaft of the gas separator 126. In the configuration illustrated in FIG. 1, the second downhole transmission assembly 125 is downhole of the fluid intake 135 and the second downhole transmission assembly 125 does not comprise flow passages as does the first downhole transmission assembly 127 as illustrated in and described with reference to FIG. 2A, FIG. 2B, and FIG. 2C. In another configuration, however, the fluid intake 134 may be located uphole of the seal section 124 and downhole of the second downhole transmission assembly 125, and in this case the second downhole transmission assembly 125 does comprise flow passages like those illustrated in and described with reference to FIG. 2A, FIG. 2B, and FIG. 2C.

In an embodiment, the ESP assembly 132 does not have the second downhole transmission assembly 125, and the uphole end of the seal section 124 is coupled directly to the downhole end of the fluid intake 135, and the uphole end of the fluid intake is coupled directly to the downhole end of the gas separator 126. In this case, the electric motor 122 may be controlled to provide a higher angular speed (i.e., a higher RPM) than is desired for the centrifugal pump assembly 128, and the first downhole transmission assembly 127 reduces the angular speed provided to the centrifugal pump assembly 128. In an embodiment, the angular speed of the electric motor 122 may be controlled by the electric power provided via the electric cable 123 to the electric motor 122. For example, a variable speed drive (VSD) located at the surface proximate the wellhead 156 may provide angular speed control of the electric motor 122 and hence speed control for the gas separator 126 and for the centrifugal pump assembly 128. The angular speed of the electric motor 122 may be controlled within a range of RPM, for example in the range between 2500 RPM and 4500 RPM, in the range between 3000 RPM and 4000 RPM, or in the range between 3300 RPM and 3700 RPM. In an embodiment, the angular speed of the electric motor 122 may be controlled by varying the frequency of the electric power provided to the electric motor 122, for example between 30 Hz and 120 Hz or between 45 Hz and 75 Hz.

In an embodiment, the ESP assembly 132 does not have the first downhole transmission assembly 127 and does have the second downhole transmission assembly 125. In this case, the electric motor 122 can be run at a lower speed to run cooler while the gas separator 126 and the centrifugal pump assembly 128 can be operated at a higher speed by the second downhole transmission assembly 125 boosting the speed (e.g., transforming the RPM of the first drive shaft 180 to the higher RPM of the second drive shaft 186).

Figure 3A:
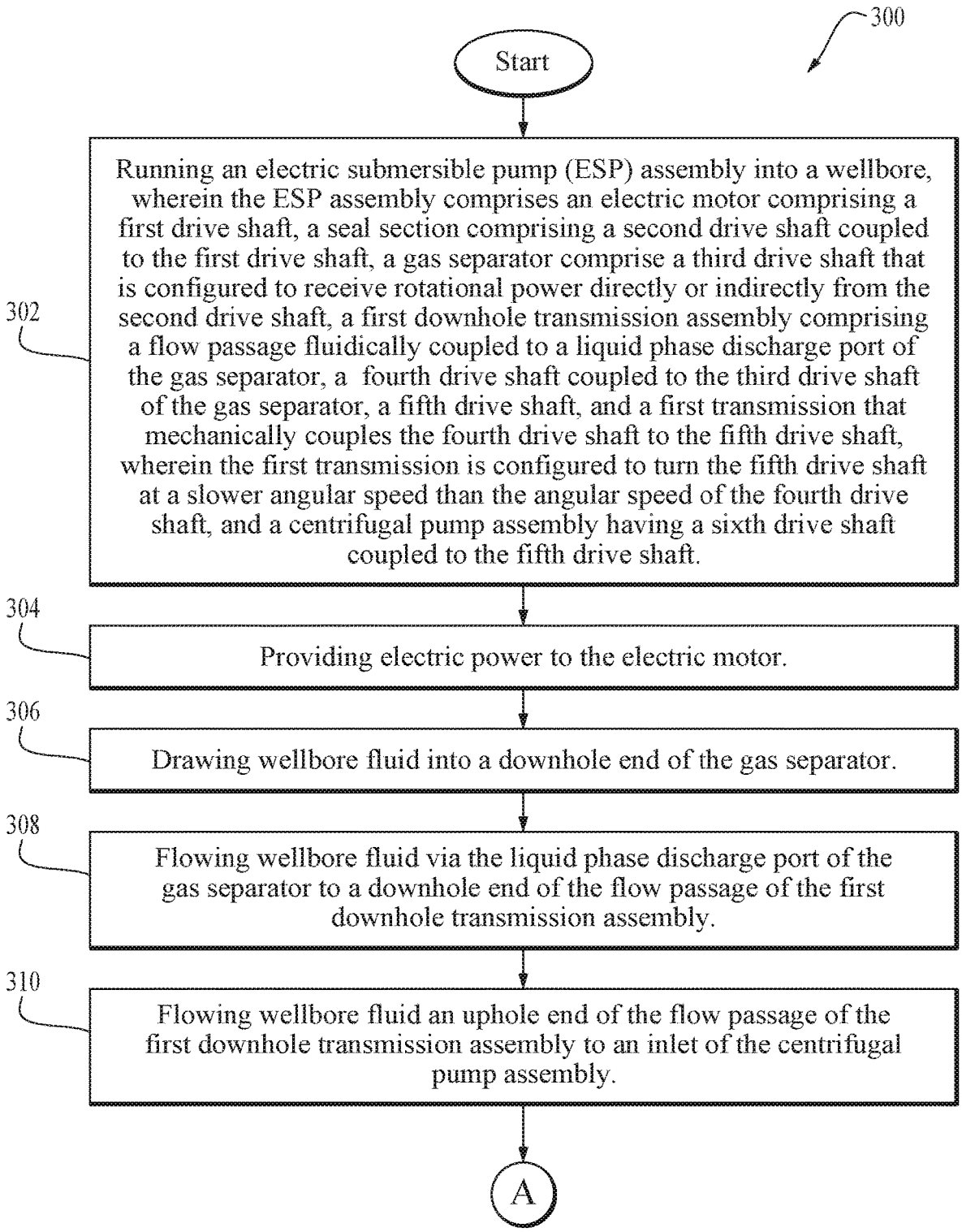
FIG. 3A and FIG. 3B is a flow chart of a method according to an embodiment of the disclosure.
Figure 3B:
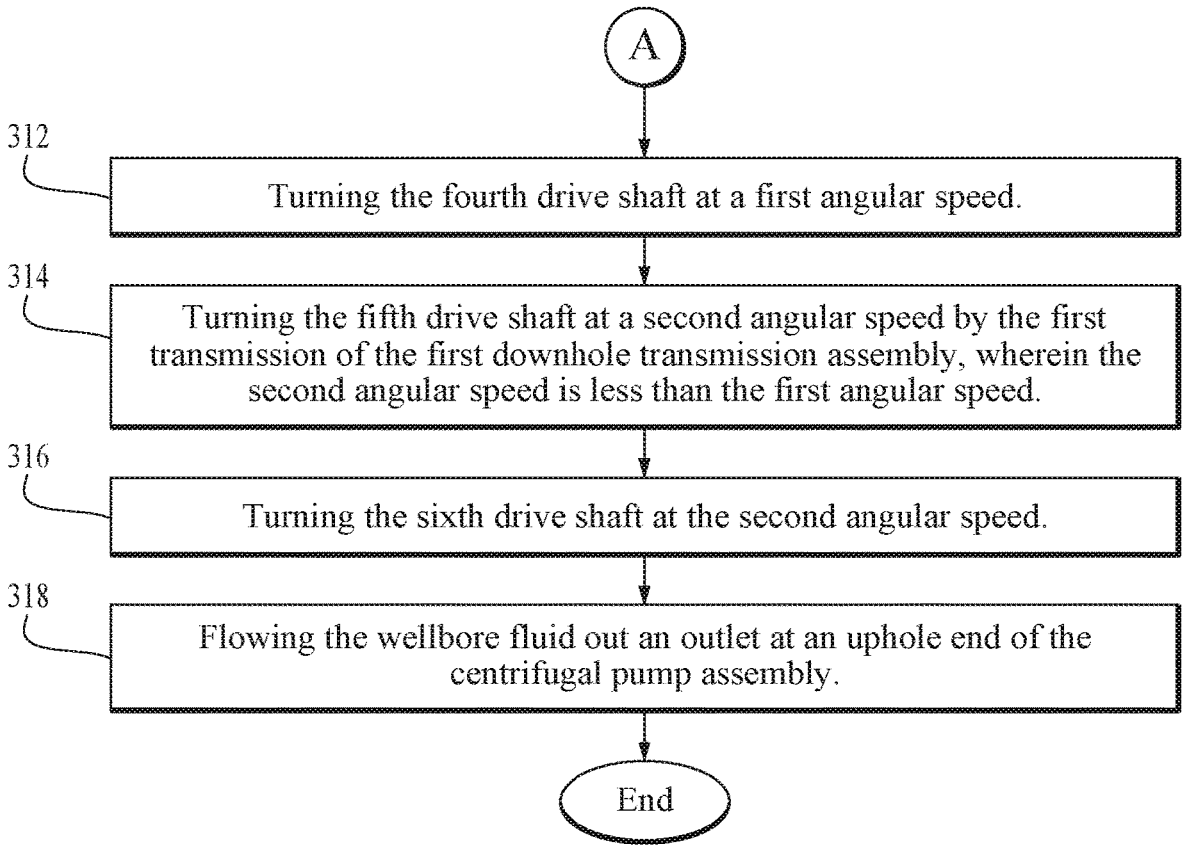

Turning now to FIG. 3, a method 300 is described. In an embodiment, the method 300 is a method of lifting wellbore fluid to a surface. At block 302, the method 300 comprises running an electric submersible pump (ESP) assembly into a wellbore, wherein the ESP assembly comprises an electric motor comprising a first drive shaft, a seal section comprising a second drive shaft coupled to the first drive shaft, a gas separator comprising a third drive shaft that is configured to receive rotational power directly or indirectly from the second drive shaft, a first downhole transmission assembly comprising a flow passage fluidically coupled to a liquid phase discharge port of the gas separator, a fourth drive shaft coupled to the third drive shaft of the gas separator, a fifth drive shaft, and a first transmission that mechanically couples the fourth drive shaft to the fifth drive shaft, wherein the first transmission is configured to turn the fifth drive shaft at a slower angular speed than the angular speed of the fourth drive shaft, and a centrifugal pump assembly having a sixth drive shaft coupled to the fifth drive shaft.

At block 304, the method 300 comprises providing electric power to the electric motor. At block 306, the method 300 comprises drawing wellbore fluid into a downhole end of the gas separator. At block 308, the method 300 comprises flowing wellbore fluid via the liquid phase discharge port of the gas separator to a downhole end of the flow passage of the first downhole transmission assembly. At block 310, the method 300 comprises flowing wellbore fluid an uphole end of the flow passage of the first downhole transmission assembly to an inlet of the centrifugal pump assembly.

At block 312, the method 300 comprises turning the fourth drive shaft at a first angular speed. At block 314, the method 300 comprises turning the fifth drive shaft at a second angular speed by the first transmission of the first downhole transmission assembly, wherein the second angular speed is less than the first angular speed. At block 316, the method 300 comprises turning the sixth drive shaft at the second angular speed. At block 318, the method 300 comprises flowing the wellbore fluid out an outlet at an uphole end of the centrifugal pump assembly.

In an embodiment, the ESP assembly further comprises a second downhole transmission assembly disposed between the seal section and the gas separator, wherein the second downhole transmission assembly comprises a seventh drive shaft coupled to the second drive shaft, an eighth drive shaft coupled to the third drive shaft, and a second transmission that mechanically couples the seventh drive shaft to the eighth drive shaft, wherein the second transmission is configured to turn the eighth drive shaft at a faster angular speed than the angular speed of the seventh drive shaft, wherein the third drive shaft receives rotational power indirectly from the second drive shaft via the second downhole transmission assembly. In an embodiment, the seventh drive shaft turns at an angular speed of from 3350 revolutions per minute to 3750 revolutions per minute and the eighth drive shaft turns at an angular speed of from 1.25 times and 1.75 times the angular speed of the seventh drive shaft. In an embodiment, the fifth drive shaft turns at an angular speed of from 3350 revolutions per minute to 3750 revolutions per minute.

Figure 4:
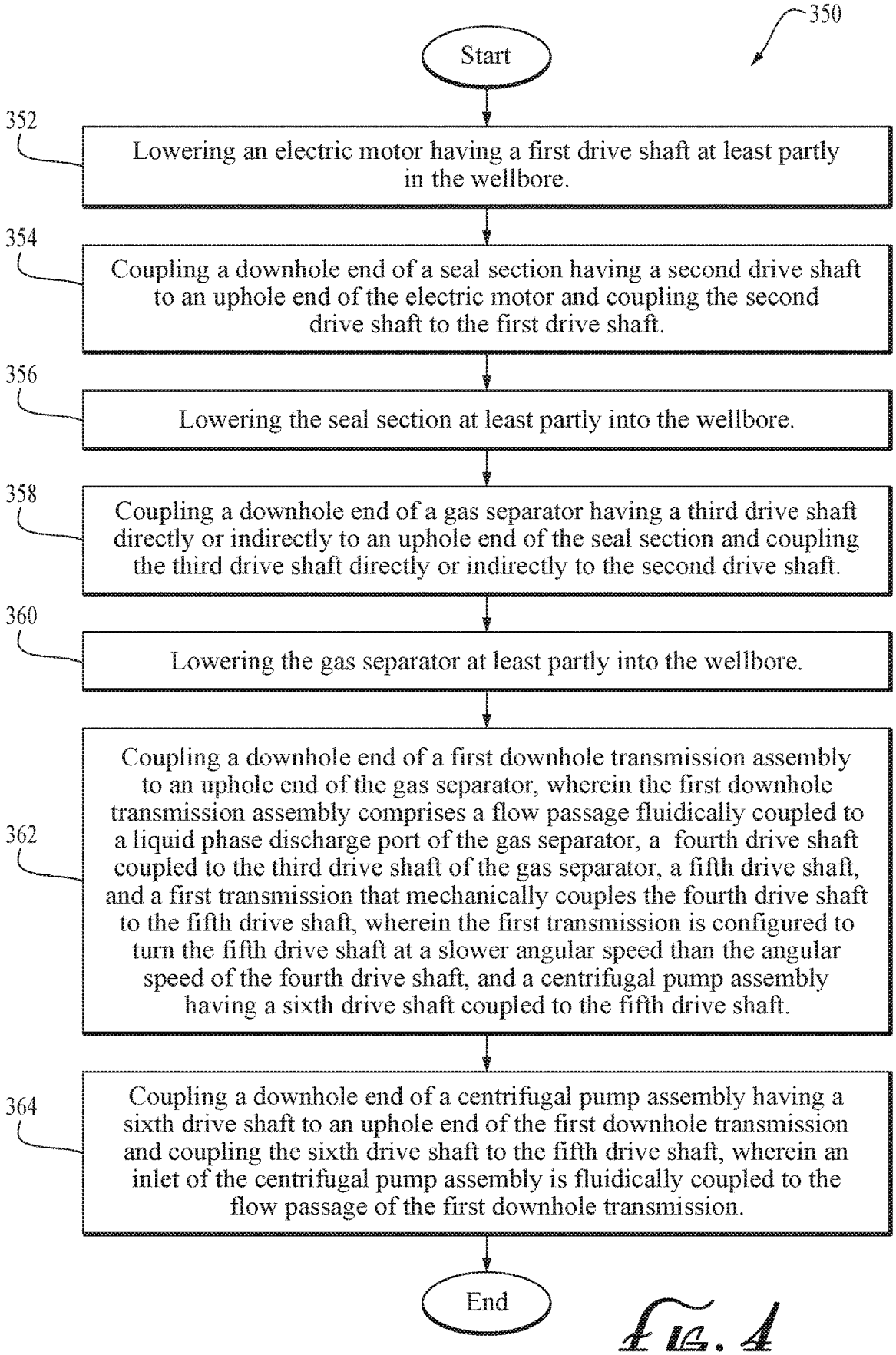
FIG. 4 is a flow chart of another method according to an embodiment of the disclosure.

Turning now to FIG. 4, a method 350 is described. In an embodiment, the method 350 is a method of assembling an electrical submersible pump (ESP) assembly at a wellbore location. At block 352, the method 350 comprises lowering an electric motor having a first drive shaft at least partly in the wellbore. At block 354, the method 350 comprises coupling a downhole end of a seal section having a second drive shaft to an uphole end of the electric motor and coupling the second drive shaft to the first drive shaft. At block 356, the method 350 comprises lowering the seal section at least partly into the wellbore.

At block 358, the method 350 comprises coupling a downhole end of a gas separator having a third drive shaft directly or indirectly to an uphole end of the seal section and coupling the third drive shaft directly or indirectly to the second drive shaft. At block 360, the method 350 comprises lowering the gas separator at least partly into the wellbore.

At block 362, the method 350 comprises coupling a downhole end of a first downhole transmission assembly to an uphole end of the gas separator, wherein the first downhole transmission assembly comprises a flow passage fluidically coupled to a liquid phase discharge port of the gas separator, a fourth drive shaft coupled to the third drive shaft of the gas separator, a fifth drive shaft, and a first transmission that mechanically couples the fourth drive shaft to the fifth drive shaft, wherein the first transmission is configured to turn the fifth drive shaft at a slower angular speed than the angular speed of the fourth drive shaft, and a centrifugal pump assembly having a sixth drive shaft coupled to the fifth drive shaft. In an embodiment, the first transmission comprises an epicyclic gear train. At block 364, the method 350 comprises coupling a downhole end of the centrifugal pump assembly to an uphole end of the first downhole transmission and coupling the sixth drive shaft to the fifth drive shaft, wherein an inlet of the centrifugal pump assembly is fluidically coupled to the flow passage of the first downhole transmission.

In an embodiment, the gas separator of method 350 comprises a fluid intake defining a plurality of inlet ports at its downhole end, and wherein the fluid intake of the gas separator couples directly to the uphole end of the seal section and the third drive shaft is coupled directly to the second drive shaft. In an embodiment, the method 350 further comprises coupling a downhole end of a fluid intake defining a plurality of inlet ports to the uphole end of the seal section, coupling an uphole end of the fluid intake to the downhole end of the gas separator, wherein the gas separator couples indirectly to the uphole end of the seal section via the fluid intake and the third drive shaft is coupled directly to the second drive shaft.

In an embodiment, the method 350 further comprises coupling a downhole end of a fluid intake defining a plurality of inlet ports to the uphole end of the seal section, coupling a downhole end of a second downhole transmission assembly to an uphole end of the fluid intake, coupling a seventh drive shaft of the second downhole transmission assembly to the second drive shaft, coupling an eighth drive shaft of the second downhole transmission assembly to the third drive shaft, and coupling coupling an uphole end of the second downhole transmission assembly to the downhole end of the gas separator, wherein the gas separator is coupled indirectly to the uphole end of the seal section via the fluid intake and via the second downhole transmission assembly, wherein the second downhole transmission assembly comprises a second transmission that couples the seventh drive shaft to the eight drive shaft, wherein the third drive shaft is coupled indirectly to the second drive shaft via the seventh drive shaft, the second transmission, and the eighth drive shaft, and wherein flow passages of the second downhole transmission assembly fluidically couple the fluid intake to the gas separator. In an embodiment, the method 350 further comprises coupling a downhole end of a second downhole transmission to the uphole end of the seal section, coupling a downhole end of a fluid intake defining a plurality of inlet ports to the uphole end of the second downhole transmission, coupling a seventh drive shaft of the second downhole transmission assembly to the second drive shaft, coupling an eighth drive shaft of the second downhole transmission assembly to the third drive shaft, and coupling an uphole end of the fluid intake to the downhole end of the gas separator, wherein the gas separator is coupled indirectly to the uphole end of the seal section via the second downhole transmission assembly and via the fluid intake, wherein the second downhole transmission assembly comprises a second transmission that couples the seventh drive shaft to the eight drive shaft, wherein the third drive shaft is coupled indirectly to the second drive shaft via the seventh drive shaft, the second transmission, and the eighth drive shaft.

Additional Embodiments

The following are non-limiting, specific embodiments in accordance with the present disclosure:

A first embodiment, which is an electric submersible pump (ESP) assembly comprising an electric motor comprising a first drive shaft; a seal section disposed uphole of the electric motor comprising a second drive shaft coupled to the first drive shaft; a gas separator disposed uphole of the seal section comprising a third drive shaft coupled directly or indirectly to the second drive shaft, wherein the gas separator is fluidically coupled to an exterior of the electric submersible pump assembly and wherein the gas separator comprises a fluid mover and a gas flow path and liquid flow path separator having a gas phase discharge port open to an exterior of the gas separator and a liquid phase discharge port; a first downhole transmission assembly disposed uphole of the gas separator, comprising a flow passage fluidically coupled to the liquid phase discharge port of the gas separator, a fourth drive shaft coupled to the third drive shaft of the gas separator, a fifth drive shaft, and a transmission that mechanically couples the fourth drive shaft to the fifth drive shaft, wherein the transmission is configured to turn the fifth drive shaft at a slower angular speed than the angular speed of the fourth drive shaft; and a centrifugal pump assembly disposed uphole of the first downhole transmission assembly, wherein the centrifugal pump assembly comprises an inlet that is fluidically coupled to the flow passage of the first transmission, a sixth drive shaft that is coupled to the fifth drive shaft, and a plurality of pump stages, wherein each pump stage comprises an impeller coupled to the sixth drive shaft drive shaft and a diffuser retained by a housing of the centrifugal pump assembly.

A second embodiment, which is the ESP assembly of the first embodiment, wherein the transmission of the first downhole transmission assembly is configured to turn the fifth drive shaft at an angular speed in the range from one third (1/3) of the angular speed of the fourth drive shaft to four fifths (4/5) of the angular speed of the fourth drive shaft.

A third embodiment, which is the ESP assembly of the first or second embodiment, wherein the transmission of the first downhole transmission assembly is configured to turn the fifth drive shaft at an angular speed of about two thirds (2/3) of the angular speed of the fourth drive shaft.

A fourth embodiment, which is the ESP assembly of any of the first through the third embodiment, further comprising a second downhole transmission assembly disposed downhole of the gas separator, comprising a seventh drive shaft coupled to the second drive shaft of the gas separator, an eighth drive shaft coupled to the third drive shaft of the gas separator, and a transmission that mechanically couples the seventh drive shaft to the eighth drive shaft, wherein the transmission is configured to turn the eighth drive shaft at a faster angular speed than the angular speed of the seventh drive shaft.

A fifth embodiment, which is the ESP assembly of the fourth embodiment, wherein the transmission of the second downhole transmission assembly is configured to turn the eighth drive shaft at an angular speed in the range from 3 times faster than the angular speed of the seventh drive shaft to one and a quarter times faster than the angular speed of the seventh drive shaft.

A sixth embodiment, which is the ESP assembly of the fourth embodiment, wherein the transmission of the second downhole transmission assembly is configured to turn the eighth drive shaft at an angular speed about one and a half times faster than the angular speed of the seventh drive shaft.

A seventh embodiment, which is the ESP assembly of the fourth embodiment, wherein the second downhole transmission assembly is of the same structure as the first downhole transmission assembly installed into the ESP assembly upside down relative to the first downhole transmission assembly, wherein the eighth drive shaft of the second downhole transmission corresponds to the third drive shaft of the first downhole transmission and the seventh drive shaft of the second downhole transmission corresponds to the fourth drive shaft of the first downhole transmission.

An eighth embodiment, which is the ESP assembly of any of the first through the seventh embodiment, wherein the transmission of the first downhole transmission comprises an annular transmission.

A ninth embodiment, which is the ESP assembly of any of the first through the eighth embodiment, wherein the transmission of the first downhole transmission comprises an epicyclic gear train.

A tenth embodiment, which is the ESP assembly of the ninth embodiment, wherein the epicyclic gear train comprises a ring gear, a sun gear coupled to the fourth drive shaft, a plurality of planet gears coupled to a planetary gear carrier that is coupled to the fifth drive shaft, wherein the sun gear meshes with the planet gears and the planet gears mesh with the ring gear.

An eleventh embodiment, which is a method of lifting wellbore fluid to a surface comprising running an electric submersible pump (ESP) assembly into a wellbore, wherein the ESP assembly comprises an electric motor comprising a first drive shaft, a seal section comprising a second drive shaft coupled to the first drive shaft, a gas separator comprising a third drive shaft that is configured to receive rotational power directly or indirectly from the second drive shaft, a first downhole transmission assembly comprising a flow passage fluidically coupled to a liquid phase discharge port of the gas separator, a fourth drive shaft coupled to the third drive shaft of the gas separator, a fifth drive shaft, and a first transmission that mechanically couples the fourth drive shaft to the fifth drive shaft, wherein the first transmission is configured to turn the fifth drive shaft at a slower angular speed than the angular speed of the fourth drive shaft, and a centrifugal pump assembly having a sixth drive shaft coupled to the fifth drive shaft; providing electric power to the electric motor; drawing wellbore fluid into a downhole end of the gas separator; flowing wellbore fluid via the liquid phase discharge port of the gas separator to a downhole end of the flow passage of the first downhole transmission assembly; flowing wellbore fluid an uphole end of the flow passage of the first downhole transmission assembly to an inlet of the centrifugal pump assembly; turning the fourth drive shaft at a first angular speed; turning the fifth drive shaft at a second angular speed by the first transmission of the first downhole transmission assembly, wherein the second angular speed is less than the first angular speed; turning the sixth drive shaft at the second angular speed; and flowing the wellbore fluid out an outlet at an uphole end of the centrifugal pump assembly.

A twelfth embodiment, which is the method of the eleventh embodiment, wherein the ESP assembly further comprises a second downhole transmission assembly disposed between the seal section and the gas separator, wherein the second downhole transmission assembly comprises a seventh drive shaft coupled to the second drive shaft, an eighth drive shaft coupled to the third drive shaft, and a second transmission that mechanically couples the seventh drive shaft to the eighth drive shaft, wherein the second transmission is configured to turn the eighth drive shaft at a faster angular speed than the angular speed of the seventh drive shaft, wherein the third drive shaft receives rotational power indirectly from the second drive shaft via the second downhole transmission assembly.

A thirteenth embodiment, which is the method of the twelfth embodiment, wherein the seventh drive shaft turns at an angular speed of from 3350 revolutions per minute to 3750 revolutions per minute and the eighth drive shaft turns at an angular speed of from 1.25 times and 1.75 times the angular speed of the seventh drive shaft.

A fourteenth embodiment, which is the method of any of the eleventh through the thirteenth embodiment, wherein the fifth drive shaft turns at an angular speed of from 3350 revolutions per minute to 3750 revolutions per minute.

A fifteenth embodiment, which is a method of assembling an electrical submersible pump (ESP) assembly at a wellbore location comprising lowering an electric motor having a first drive shaft at least partly in the wellbore; coupling a downhole end of a seal section having a second drive shaft to an uphole end of the electric motor and coupling the second drive shaft to the first drive shaft; lowering the seal section at least partly into the wellbore; coupling a downhole end of a gas separator having a third drive shaft directly or indirectly to an uphole end of the seal section and coupling the third drive shaft directly or indirectly to the second drive shaft; lowering the gas separator at least partly into the wellbore; coupling a downhole end of a first downhole transmission assembly to an uphole end of the gas separator, wherein the first downhole transmission assembly comprises a flow passage fluidically coupled to a liquid phase discharge port of the gas separator, a fourth drive shaft coupled to the third drive shaft of the gas separator, a fifth drive shaft, and a first transmission that mechanically couples the fourth drive shaft to the fifth drive shaft, wherein the first transmission is configured to turn the fifth drive shaft at a slower angular speed than the angular speed of the fourth drive shaft, and a centrifugal pump assembly having a sixth drive shaft coupled to the fifth drive shaft; and coupling a downhole end of the centrifugal pump assembly to an uphole end of the first downhole transmission and coupling the sixth drive shaft to the fifth drive shaft, wherein an inlet of the centrifugal pump assembly is fluidically coupled to the flow passage of the first downhole transmission.

A sixteenth embodiment, which is the method of the fifteenth embodiment, wherein the gas separator comprises a fluid intake defining a plurality of inlet ports at its downhole end, and wherein the fluid intake of the gas separator couples directly to the uphole end of the seal section and the third drive shaft is coupled directly to the second drive shaft.

A seventeenth embodiment, which is the method of the fifteenth or sixteenth embodiment, further comprising coupling a downhole end of a fluid intake defining a plurality of inlet ports to the uphole end of the seal section, coupling an uphole end of the fluid intake to the downhole end of the gas separator, wherein the gas separator couples indirectly to the uphole end of the seal section via the fluid intake and the third drive shaft is coupled directly to the second drive shaft.

An eighteenth embodiment, which is the method of any of the fifteenth through the seventeenth embodiment, further comprising coupling a downhole end of a fluid intake defining a plurality of inlet ports to the uphole end of the seal section, coupling a downhole end of a second downhole transmission assembly to an uphole end of the fluid intake, coupling a seventh drive shaft of the second downhole transmission assembly to the second drive shaft, coupling an eighth drive shaft of the second downhole transmission assembly to the third drive shaft, and coupling coupling an uphole end of the second downhole transmission assembly to the downhole end of the gas separator, wherein the gas separator is coupled indirectly to the uphole end of the seal section via the fluid intake and via the second downhole transmission assembly, wherein the second downhole transmission assembly comprises a second transmission that couples the seventh drive shaft to the eight drive shaft, wherein the third drive shaft is coupled indirectly to the second drive shaft via the seventh drive shaft, the second transmission, and the eighth drive shaft, and wherein flow passages of the second downhole transmission assembly fluidically couple the fluid intake to the gas separator.

A nineteenth embodiment, which is the method of any of the fifteenth through the eighteenth embodiment, further comprising coupling a downhole end of a second downhole transmission to the uphole end of the seal section, coupling a downhole end of a fluid intake defining a plurality of inlet ports to the uphole end of the second downhole transmission, coupling a seventh drive shaft of the second downhole transmission assembly to the second drive shaft, coupling an eighth drive shaft of the second downhole transmission assembly to the third drive shaft, and coupling an uphole end of the fluid intake to the downhole end of the gas separator, wherein the gas separator is coupled indirectly to the uphole end of the seal section via the second downhole transmission assembly and via the fluid intake, wherein the second downhole transmission assembly comprises a second transmission that couples the seventh drive shaft to the eight drive shaft, wherein the third drive shaft is coupled indirectly to the second drive shaft via the seventh drive shaft, the second transmission, and the eighth drive shaft.

A twentieth embodiment, which is the method of any of the fifteenth through the nineteenth embodiment, wherein the first transmission comprises an epicyclic gear train.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k* (Ru-RI), wherein k is a variable ranging from 1 percent to 100 percent with a 1 percent increment, i.e., k is 1 percent, 2 percent, 3 percent, 4 percent, 5 percent, 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. An electric submersible pump (ESP) assembly, comprising:

an electric motor comprising a first drive shaft;

a seal section disposed uphole of the electric motor comprising a second drive shaft coupled to the first drive shaft;

a gas separator disposed uphole of the seal section comprising a third drive shaft coupled directly or indirectly to the second drive shaft, wherein the gas separator is fluidically coupled to an exterior of the electric submersible pump assembly and wherein the gas separator comprises a fluid mover and a gas flow path and liquid flow path separator having a gas phase discharge port open to an exterior of the gas separator and a liquid phase discharge port;

a first downhole transmission assembly disposed uphole of the gas separator, comprising a flow passage fluidically coupled to the liquid phase discharge port of the gas separator, a fourth drive shaft coupled to the third drive shaft of the gas separator, a fifth drive shaft, and a transmission that mechanically couples the fourth drive shaft to the fifth drive shaft, wherein the transmission is configured to turn the fifth drive shaft at a different angular speed than the angular speed of the fourth drive shaft; and a centrifugal pump assembly disposed uphole of the first downhole transmission assembly, wherein the centrifugal pump assembly comprises an inlet that is fluidically coupled to the flow passage of the first downhole transmission assembly, a sixth drive shaft that is coupled to the fifth drive shaft, and a plurality of pump stages, wherein each pump stage comprises an impeller coupled to the sixth drive shaft drive shaft and a diffuser retained by a housing of the centrifugal pump assembly.

2. The ESP assembly of claim 1, wherein the transmission of the first downhole transmission assembly is configured to turn the fifth drive shaft at an angular speed in the range from one third (⅓) of the angular speed of the fourth drive shaft to four fifths (⅘) of the angular speed of the fourth drive shaft.

3. The ESP assembly of claim 1, wherein the transmission of the first downhole transmission assembly is configured to turn the fifth drive shaft at an angular speed of about two thirds (⅔) of the angular speed of the fourth drive shaft.

4. The ESP assembly of claim 1, further comprising a second downhole transmission assembly disposed downhole of the gas separator, comprising a seventh drive shaft coupled to the second drive shaft of the gas separator, an eighth drive shaft coupled to the third drive shaft of the gas separator, and a transmission that mechanically couples the seventh drive shaft to the eighth drive shaft, wherein the transmission is configured to turn the eighth drive shaft at a different angular speed than the angular speed of the seventh drive shaft.

5. The ESP assembly of claim 4, wherein the transmission of the second downhole transmission assembly is configured to turn the eighth drive shaft at an angular speed in the range from 3 times faster than the angular speed of the seventh drive shaft to one and a quarter times faster than the angular speed of the seventh drive shaft.

6. The ESP assembly of claim 4, wherein the transmission of the second downhole transmission assembly is configured to turn the eighth drive shaft at an angular speed about one and a half times faster than the angular speed of the seventh drive shaft.

7. The ESP assembly of claim 4, wherein the second downhole transmission assembly is of the same structure as the first downhole transmission assembly installed into the ESP assembly upside down relative to the first downhole transmission assembly, wherein the eighth drive shaft of the second downhole transmission corresponds to the third drive shaft of the first downhole transmission and the seventh drive shaft of the second downhole transmission corresponds to the fourth drive shaft of the first downhole transmission.

8. The ESP assembly of claim 1, wherein the transmission of the first downhole transmission comprises an annular transmission.

9. The ESP assembly of claim 1, wherein the transmission of the first downhole transmission comprises an epicyclic gear train.

10. The ESP assembly of claim 9, wherein the epicyclic gear train comprises a ring gear, a sun gear coupled to the fourth drive shaft, a plurality of planet gears coupled to a planetary gear carrier that is coupled to the fifth drive shaft, wherein the sun gear meshes with the planet gears and the planet gears mesh with the ring gear.

11. The ESP assembly of claim 1, wherein the transmission is configured to turn the fifth drive shaft at a slower angular speed than the angular speed of the fourth drive shaft.

12. The ESP assembly of claim 1, wherein the transmission is configured to turn the fifth drive shaft at a faster angular speed than the angular speed of the fourth drive shaft.

13. The ESP assembly of claim 1, wherein the transmission is configured to turn the fifth drive shaft in the same rotational sense as the fourth drive shaft.

14. The ESP assembly of claim 1, wherein the transmission is configured to turn the fifth drive shaft in the opposite rotational sense as the fourth drive shaft.

15. The ESP assembly of claim 1, wherein the flow passage of the first downhole transmission assembly is disposed radially outwards from the transmission of the first downhole transmission assembly.

16. The ESP assembly of claim 1, wherein the first downhole transmission assembly comprises a housing that defines the flow passage and that retains the transmission.

17. The ESP assembly of claim 16, wherein the housing defines a plurality of flow passages.

18. The ESP assembly of claim 17, wherein each of the flow passages extend axially from a downhole end of the housing to an uphole end of the housing and wherein a radial cross-section of each flow passage defines a curved fabiform shape.

19. A method of lifting wellbore fluid to a surface, comprising:

running an electric submersible pump (ESP) assembly into a wellbore, wherein the ESP assembly comprises an electric motor comprising a first drive shaft, a seal section comprising a second drive shaft coupled to the first drive shaft, a gas separator comprising a third drive shaft that is configured to receive rotational power directly or indirectly from the second drive shaft, a first downhole transmission assembly comprising a flow passage fluidically coupled to a liquid phase discharge port of the gas separator, a fourth drive shaft coupled to the third drive shaft of the gas separator, a fifth drive shaft, and a first transmission that mechanically couples the fourth drive shaft to the fifth drive shaft, wherein the first transmission is configured to turn the fifth drive shaft at a different angular speed than the angular speed of the fourth drive shaft, and a centrifugal pump assembly having a sixth drive shaft coupled to the fifth drive shaft;

providing electric power to the electric motor;

drawing wellbore fluid into a downhole end of the gas separator;

flowing wellbore fluid via the liquid phase discharge port of the gas separator to a downhole end of the flow passage of the first downhole transmission assembly;

flowing wellbore fluid an uphole end of the flow passage of the first downhole transmission assembly to an inlet of the centrifugal pump assembly;

turning the fourth drive shaft at a first angular speed;

turning the fifth drive shaft at a second angular speed by the first transmission of the first downhole transmission assembly, wherein the second angular speed is different than the first angular speed;

turning the sixth drive shaft at the second angular speed; and flowing the wellbore fluid out an outlet at an uphole end of the centrifugal pump assembly.

20. The method of claim 19, wherein the ESP assembly further comprises a second downhole transmission assembly disposed between the seal section and the gas separator, wherein the second downhole transmission assembly comprises a seventh drive shaft coupled to the second drive shaft, an eighth drive shaft coupled to the third drive shaft, and a second transmission that mechanically couples the seventh drive shaft to the eighth drive shaft, wherein the second transmission is configured to turn the eighth drive shaft at a different angular speed than the angular speed of the seventh drive shaft, wherein the third drive shaft receives rotational power indirectly from the second drive shaft via the second downhole transmission assembly.

21. The method of claim 20, wherein the seventh drive shaft turns at an angular speed of from 3350 revolutions per minute to 3750 revolutions per minute and the eighth drive shaft turns at an angular speed of from 1.25 times and 1.75 times the angular speed of the seventh drive shaft.

22. The method of claim 19, wherein the fifth drive shaft turns at an angular speed of from 3350 revolutions per minute to 3750 revolutions per minute.

23. A method of assembling an electrical submersible pump (ESP) assembly at a wellbore location, comprising:

lowering an electric motor having a first drive shaft at least partly in the wellbore;

coupling a downhole end of a seal section having a second drive shaft to an uphole end of the electric motor and coupling the second drive shaft to the first drive shaft;

lowering the seal section at least partly into the wellbore;

coupling a downhole end of a gas separator having a third drive shaft directly or indirectly to an uphole end of the seal section and coupling the third drive shaft directly or indirectly to the second drive shaft;

lowering the gas separator at least partly into the wellbore;

coupling a downhole end of a first downhole transmission assembly to an uphole end of the gas separator, wherein the first downhole transmission assembly comprises a flow passage fluidically coupled to a liquid phase discharge port of the gas separator, a fourth drive shaft coupled to the third drive shaft of the gas separator, a fifth drive shaft, and a first transmission that mechanically couples the fourth drive shaft to the fifth drive shaft, wherein the first transmission is configured to turn the fifth drive shaft at a different angular speed than the angular speed of the fourth drive shaft, and a centrifugal pump assembly having a sixth drive shaft coupled to the fifth drive shaft; and coupling a downhole end of the centrifugal pump assembly to an uphole end of the first downhole transmission and coupling the sixth drive shaft to the fifth drive shaft, wherein an inlet of the centrifugal pump assembly is fluidically coupled to the flow passage of the first downhole transmission.

24. The method of claim 23, wherein the gas separator comprises a fluid intake defining a plurality of inlet ports at its downhole end, and wherein the fluid intake of the gas separator couples directly to the uphole end of the seal section and the third drive shaft is coupled directly to the second drive shaft.

25. The method of claim 23, further comprising coupling a downhole end of a fluid intake defining a plurality of inlet ports to the uphole end of the seal section, coupling an uphole end of the fluid intake to the downhole end of the gas separator, wherein the gas separator couples indirectly to the uphole end of the seal section via the fluid intake and the third drive shaft is coupled directly to the second drive shaft.

26. The method of claim 23, further comprising coupling a downhole end of a fluid intake defining a plurality of inlet ports to the uphole end of the seal section, coupling a downhole end of a second downhole transmission assembly to an uphole end of the fluid intake, coupling a seventh drive shaft of the second downhole transmission assembly to the second drive shaft, coupling an eighth drive shaft of the second downhole transmission assembly to the third drive shaft, and coupling an uphole end of the second downhole transmission assembly to the downhole end of the gas separator, wherein the gas separator is coupled indirectly to the uphole end of the seal section via the fluid intake and via the second downhole transmission assembly, wherein the second downhole transmission assembly comprises a second transmission that couples the seventh drive shaft to the eight drive shaft, wherein the third drive shaft is coupled indirectly to the second drive shaft via the seventh drive shaft, the second transmission, and the eighth drive shaft, and wherein flow passages of the second downhole transmission assembly fluidically couple the fluid intake to the gas separator.

27. The method of claim 23, further comprising coupling a downhole end of a second downhole transmission to the uphole end of the seal section, coupling a downhole end of a fluid intake defining a plurality of inlet ports to the uphole end of the second downhole transmission, coupling a seventh drive shaft of the second downhole transmission assembly to the second drive shaft, coupling an eighth drive shaft of the second downhole transmission assembly to the third drive shaft, and coupling an uphole end of the fluid intake to the downhole end of the gas separator, wherein the gas separator is coupled indirectly to the uphole end of the seal section via the second downhole transmission assembly and via the fluid intake, wherein the second downhole transmission assembly comprises a second transmission that couples the seventh drive shaft to the eight drive shaft, wherein the third drive shaft is coupled indirectly to the second drive shaft via the seventh drive shaft, the second transmission, and the eighth drive shaft.

28. The method of claim 23, wherein the first transmission comprises an epicyclic gear train.

* * * * *